US008262255B1

(12) United States Patent
Rashidi

(10) Patent No.: US 8,262,255 B1
(45) Date of Patent: Sep. 11, 2012

(54) SMALL SIZED LED LIGHTING LUMINAIRE HAVING REPLACEABLE OPERATING COMPONENTS AND ARCUATE FINS TO PROVIDE IMPROVED HEAT DISSIPATION

(76) Inventor: Hamid Rashidi, Beverly Hills, CA (US)

( * ) Notice: Subject to any disclaimer, the term of this patent is extended or adjusted under 35 U.S.C. 154(b) by 487 days.

(21) Appl. No.: 12/592,177

(22) Filed: Nov. 20, 2009

(51) Int. Cl.
*F21V 21/00* (2006.01)

(52) U.S. Cl. ..... 362/249.02; 362/294; 362/373

(58) Field of Classification Search ..... 362/145–148, 362/240–243, 247, 249.01, 249.02, 249.11, 362/294, 296.01, 326, 327, 362–364, 373, 362/540, 543–547, 800; 257/98–100, 678, 257/706, 707, 719, 722
See application file for complete search history.

(56) References Cited

U.S. PATENT DOCUMENTS

| | | | | |
|---|---|---|---|---|
| 7,553,047 | B2 * | 6/2009 | Shin et al. | 362/294 |
| 7,670,028 | B2 * | 3/2010 | Liu et al. | 362/294 |
| 7,758,214 | B2 * | 7/2010 | Lee et al. | 362/294 |
| 2010/0014287 | A1 * | 1/2010 | Chiang et al. | 362/231 |
| 2010/0091487 | A1 * | 4/2010 | Shin | 362/235 |
| 2010/0132931 | A1 * | 6/2010 | Liaw et al. | 165/185 |

* cited by examiner

*Primary Examiner* — Hargobind S Sawhney
(74) *Attorney, Agent, or Firm* — Thomas I. Rozsa

(57) ABSTRACT

A small sized recessed LED lighting luminaire having detachable and replaceable components to enable one failed component to be replaced while the remainder of the luminaire is used and not discarded. The LED lighting luminaire includes a detachable unit comprising transverse arcuate longitudinal heat dissipation fins for effectively dissipating heat, and a reflector having interior transverse circular baffles for aesthetically transmitting light.

39 Claims, 6 Drawing Sheets

SMALL SIZED LED LIGHTING LUMINAIRE HAVING REPLACEABLE OPERATING COMPONENTS AND ARCUATE FINS TO PROVIDE IMPROVED HEAT DISSIPATION

BACKGROUND OF THE INVENTION

1. Field of the Invention

The present invention relates to the field of lighting luminaires and in particular to small sized lighting luminaires which have light emitting diodes (LEDs) as the sources of illumination.

2. Description of the Prior Art

With the development of semiconductor lighting devices, LED lighting sources including LED chips are in great demand in lighting luminaires used in both consumer and industrial markets. One problem with the existing LED lighting luminaires in the markets is that the LED lighting source generates considerable heat. Excess heat can result in failure of the operating components of the lighting luminaires. Therefore it is necessary to incorporate a heat dissipation apparatus into the LED lighting source of each luminaire in order to achieve a reasonable usable life for the luminaire.

Another problem with prior art LED lighting luminaires is that all of the components are integrated into a luminaire, so that if one component fails, malfunctions or otherwise goes bad, the failed component can't be replaced and it is necessary to replace the entire lighting luminaire. Therefore, there is a significant need for an improved lighting luminaire which contains replaceable operating components so that if one component fails, only the failed component needs to be replaced and the entire lighting luminaire does not need to be discarded.

One example of the LED lighting luminaires in the current marketplace is a small sized lighting luminaire which have an LED as the source of illumination. These small sized luminaires are fashionable for use as interior lighting for commercial buildings, art exhibits, restaurants, saloons, and book stores, and are also used for decorative residential ceiling lighting. The prior art small sized LED lighting luminaires are manufactured as single pieces with the heat dissipation sections having straight longitudinal fins. Therefore the prior art luminaires have less efficient heat dissipation which results in reduced life of the luminaires. In addition, the integrated design requires the entire prior art small sized LED luminaire to be replaced if one component malfunctions or otherwise fails in some manner.

Therefore there is a significant need for the small sized LED lighting luminaire which has an improved design including detachable and replaceable operating components and also has heat dissipation means which are improvements over prior art designs.

SUMMARY OF THE INVENTION

The present invention is a small sized LED lighting luminaire having detachable and replaceable components. Therefore, if one component fails, it can be replaced and the luminaire will continue to have a usable life. The LED lighting luminaire includes a key innovation of detachable heat dissipating means incorporated with the light reflector, comprising transversely extending arcuate longitudinal heat dissipation fins for effectively dissipating heat, and interior transverse circular baffles used in the light reflector for aesthetically transmitting light.

The detachable and replaceable components of the lighting luminaire mainly include a bottom hollow cylindrical ring cover, the detachable heat dissipating means incorporated with the light reflector comprising a lower heat dissipating apparatus affixed with the light reflector and an upper heat dissipating apparatus which are removably combined together, an LED chip affixed to the upper heat dissipating apparatus, the LED chip electrically connected to a mating connecting member of a detachable connector, and a top round plate.

The light reflector has various embodiments of patterned structure on its interior surface including transverse circular baffles. The light reflector is affixed to the lower heat dissipating apparatus. The lower heat dissipating apparatus is a hollow cylinder, comprising a body having a central longitudinal opening, and a top transverse ring surface connected to an exterior cylindrical surface. In addition, a transverse round recess of space is concentrically positioned to downwardly connect to the central opening, which further extends from the central opening to an inner circumference of the top ring surface.

Formed into the exterior surface of the cylindrical body are a multiplicity of spaced apart transversely arcuate longitudinal fins. The fins extend outwardly away from the exterior surface, and also downwardly affix to an exterior surface of the reflector, so that the lower heat dissipating apparatus and reflector are integrated together. Each longitudinal fin along a transverse orientation further extends counterclockwise or clockwise away from an adjacent radius of the ring surface with a continuous increment angle to form each respective longitudinal end side, so that each fin is arcuate and has an identical fixed length. Therefore, the longitudinal end sides of the respective fins form a cylindrical surface. In addition, each transversely arcuately longitudinal fin is separated from an adjacent identical fin by an air gap.

The upper heat dissipating apparatus also has the shape of a hollow cylinder, comprising a body including an exterior cylindrical surface and a transverse round top surface. The body is downwardly and concentrically connected to a transverse bottom round plate, so that the exterior cylindrical surface of the body connects to a top surface of the bottom round plate, wherein a diameter of the cylindrical body is smaller than that of the transverse bottom round plate. In addition, the body and round plate are both penetrated by a central longitudinal opening.

Formed into the exterior surface of the cylindrical body are a multiplicity of spaced apart arcuate longitudinal fins. The fins extend respectively and outwardly away from the exterior surface of the body to the respective longitudinal end sides, which circumferentially and downwardly connect to an exterior circumference of the transverse bottom plate. In this setting, the end sides of the respective arcuate fins form a closed cylindrical surface, whose projection is the exterior circumference of the transverse bottom round plate.

Each longitudinal fin of the upper heat dissipating apparatus further extends counterclockwise or clockwise away from an adjacent radius of the top round surface with a continuous increment angle to thereby be arcuate. In addition, each transversely arcuately longitudinal fin is separated from an adjacent identical fin by an air gap.

The present invention longitudinal arcuate fins have the following three structural characters. First, the longitudinal outer end sides of the respective arcuate fins of the respective upper and lower heat dissipating apparatus are aligned with each other in series. Second, a curvature of each identical longitudinal arcuate fin of the upper heat dissipating apparatus is consistent with that of each longitudinal arcuate fin of the lower heat dissipating apparatus. Third, a length of each identical longitudinal arcuate fin of the upper heat dissipating apparatus is longer than that of each arcuate fin of the lower apparatus. This is because a diameter of the exterior circular surface of the body of the upper heating dissipating apparatus is smaller than that of the exterior circular surface of the body of the lower heat dissipating apparatus, but both lower and upper heat dissipating apparatus have a same diametrically sized cylindrical surfaces that are formed by the respective longitudinal outer sides of the respective fins.

Therefore, another important improvement of the present invention is that the longitudinal arcuate fins and respective corresponding air gaps provide more cooling power and more efficient air circulation as compared the prior art longitudinal straight fins due to the larger surface areas of the respective arcuate longitudinal fins of the present invention as compared with the smaller surface areas of the prior art respective longitudinal straight fins.

The LED chip is affixed to a bottom side of the upper heat dissipating apparatus. Therefore, the upper heat dissipating apparatus attached with the LED chip can be easily replaced after the upper and lower heat dissipating apparatus are detached. The LED chip is a single chip which generates white light.

The present invention includes significant design improvements which are summarized as follows:

One significant improvement in the preset invention is the detachable heat dissipating means comprising lower heat dissipating apparatus affixed with the light reflector and upper heat dissipating apparatus affixed with the LED chip. In this setting, if one of the components of the detachable heat dissipating means fails or otherwise malfunctions, the one component is easily replaced by replacing either the lower heat dissipating apparatus affixed with the light reflector or the upper heat dissipating apparatus affixed with the LED chip. The remainder is salvageable and can continue to be used in the structure. The advantage of the present invention is compared with the disadvantage of the prior art LED lighting fixture that is a single integrated piece. Therefore, if one component of the prior art luminaire fails, the entire fixture is discarded.

A second significant improvement in the present invention is the inclusion of the attachment means as a retrofit kit, which makes installation of the luminaire easy and convenient according to friction forces generated by the attachment means applied to the interior of a canister.

A third significant improvement in the present invention is the use of a reflector having transverse circular baffles positioned on an interior surface to enhance aesthetic lighting effect. This improvement compares with the prior art reflector having vertically oriented steps on an interior surface of the reflector to produce a lighting effect which is less attractive.

An fourth significant improvement in the present invention is to have connection of the electricity to the LED chip through a mating connecting member, which matches another mating connecting member. This brings easy and quick operation in the electrical connection.

It is therefore an object of the present invention to provide a small sized LED lighting luminaire having the detachable and replaceable components, so that it enables one failed component to be replaced while the remainder of the luminaire is used and not discarded. The LED lighting luminaire includes a key innovation of the present invention detachable heat dissipating means incorporated with the light reflector, comprising transversely arcuate longitudinal heat dissipation fins for effectively dissipating heat, and interior transverse circular baffles of the light reflector for aesthetically transmitting light.

It is an additional object of the present invention to provide detachable and replaceable components of the lighting luminaire that mainly include a bottom hollow cylindrical ring cover, the detachable heat dissipating means incorporated with the light reflector comprising a lower heat dissipating apparatus affixed with the light reflector and an upper heat dissipating apparatus which are combined together, an LED chip affixed to the upper heat dissipating apparatus which is electrically connected to a mating connecting member of a detachable connector, and a top round plate.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
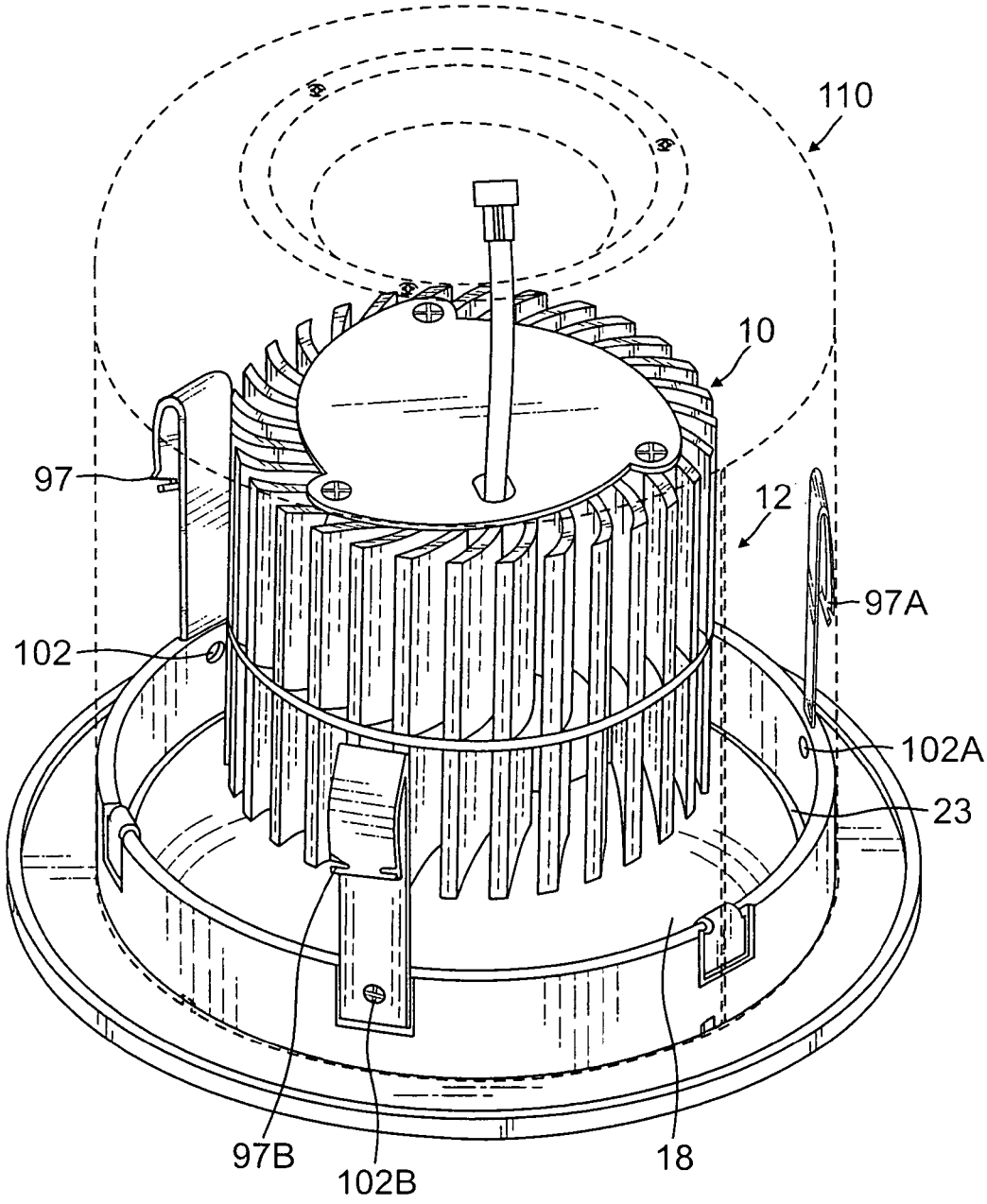
FIG. 1 is a perspective top view of a small sized LED lighting luminaire of the present invention, with a ceiling cannister into which the luminaire is inserted illustrated in dotted lines.
Figure 3:
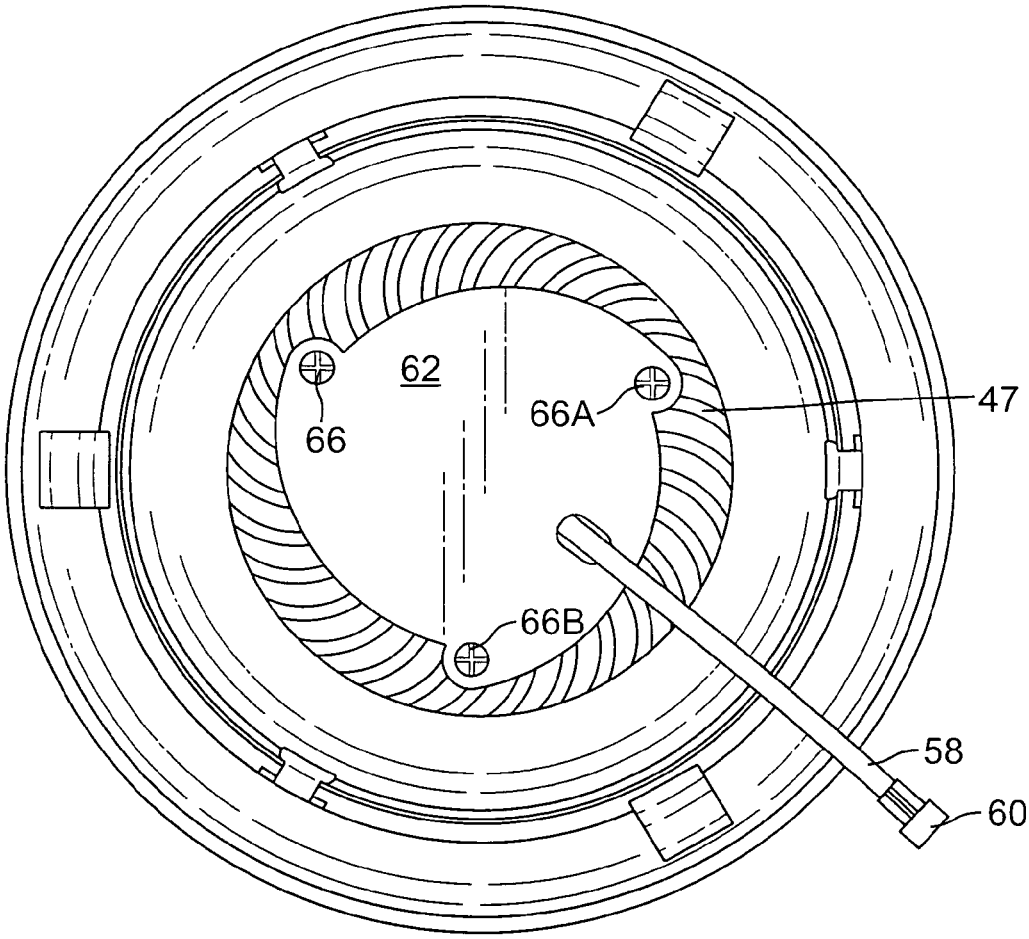
FIG. 3 is a top plan view of the present invention small sized LED lighting luminaire.
Figure 4A:
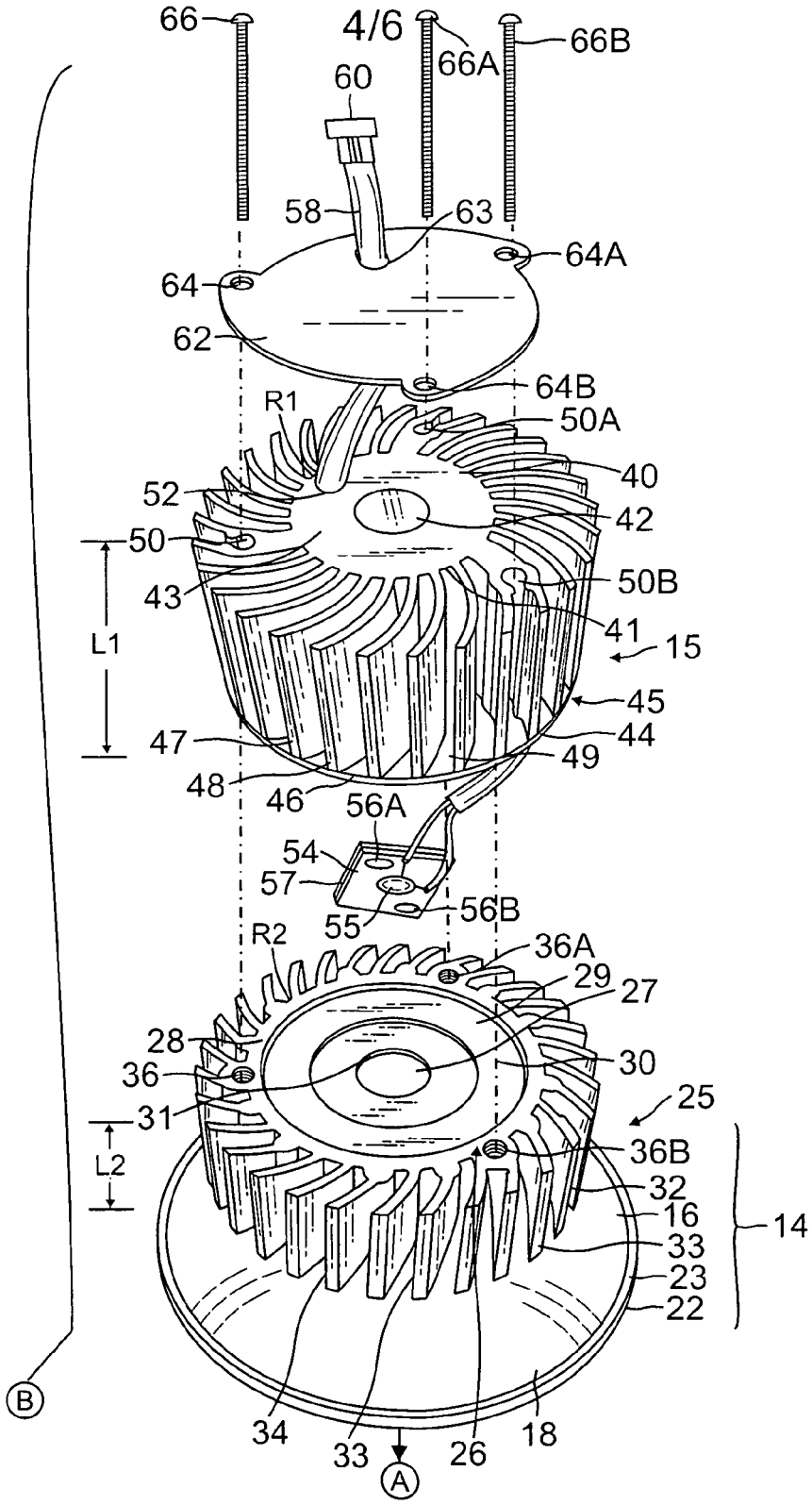
FIG. 4A is an exploded perspective view of a portion of the present invention small sized lighting luminaire illustrating a detachable heat dissipating means incorporated with a light reflector and a top plate.

Referring to FIGS. 1, 3 and 4A, there is illustrated present invention small sized recessed LED lighting luminaire 10 which is designed to have detachable and replaceable components. The LED lighting luminaire includes a heat dissipation assembly 12 comprised of a pair of detachable heat dissipating means 25 and 15 which transverse arcuate longitudinal heat dissipation fins 47 and 32 for effectively dissipating heat generated from an LED source of illumination.

Referring to FIG. 4A, the very unique unit 12 of the detachable heat dissipating means incorporated with the light reflector of the present invention includes a detachable lower or first heat dissipating apparatus 25 with a hollow light reflector 16 attached thereto and a detachable upper or second heat dissipating apparatus 15, which is a key innovation of the present invention and is a significant improvement over the prior art.

Figure 2:
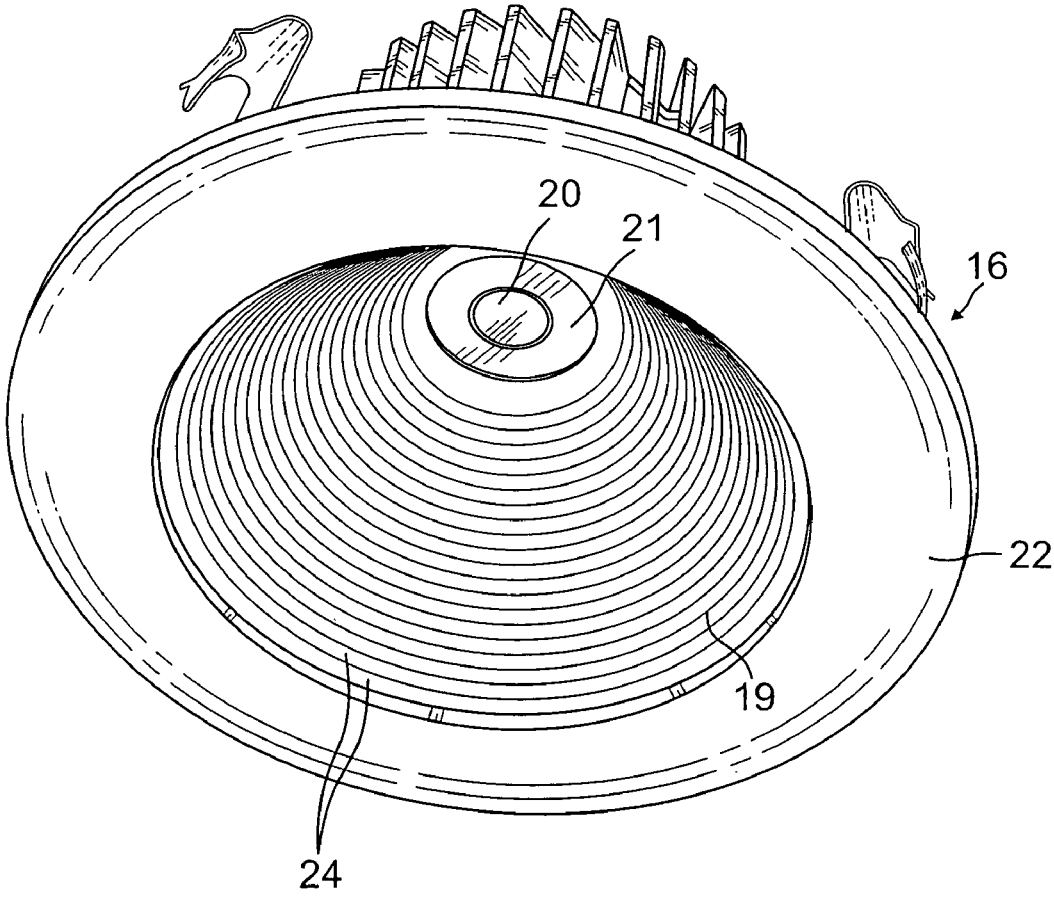
FIG. 2 is a perspective bottom view of the small sized LED lighting luminaire, wherein transverse circular baffles are formed onto the interior surface of the reflector.

Referring to FIGS. 2 and 4A, the hollow light reflector 16 has the shape of a frustum, comprising exterior and interior surfaces 18 and 19 extending from a top central plate 21 of having a central opening 20 to a bottom circumference 22 having an upwardly extending circumferential rim 23. On the interior surface 19, there are a plurality of transverse circular baffles 24, which are positioned to extend from the bottom circumference 22 upwardly to the top central plate 21 of the hollow reflector.

The lower heat dissipating apparatus 25 has the shape of a hollow cylinder, comprising a body 26, which has the central opening 20 extending from the hollow light reflector 16, a top transverse ring surface 28 connected to an exterior cylindrical surface 29. In addition, a transverse round recessed plate 30 has an interior circumference 31 which surrounds a recessed opening 20 and is surrounded by an interior recessed plate 29 which is adjacent the transverse ring surface 28.

Formed into the exterior surface of the cylindrical body 26 are a multiplicity of spaced apart transversely extending arcuate longitudinal fins 32. The fins extend outwardly away from the exterior surface of body 26, and also extend downwardly and are affixed to the exterior surface 18 of the reflector, so that the lower heat dissipating apparatus 25 and reflector 16 are formed as an integrated member 14. As further illustrated, each longitudinal fin 32 further extends in a transverse and counterclockwise arc away from the exterior surface 29 and from the ring surface 28 with a continuous incremental angle to form each respective longitudinal end side 33, so that the fins 32 are arcuately oriented with respect to exterior surface 29 and top transverse ring surface 28.

In addition, each transversely extending arcuately longitudinal fin 32 is separated from an adjacent identical fin by an air gap 34. Therefore, the first or lower heat dissipating apparatus 25 having the multiplicity of the transversely arcuate and spaced apart longitudinal heat dissipation fins 32 and multiplicity of the corresponding air gaps 34 is a part of the heat dissipating means of the present invention, with each respective longitudinal heat dissipation fin 32 separated from an adjacent identical fin by an air gap 34, wherein the multiplicity of the transversely arcuate and spaced apart longitudinal heat dissipation fins 32 and multiplicity of the corresponding air gaps 34 are the principal components for dissipating heat.

Extending into the top ring surface 28 of the body are three downward threaded openings 36, 36A and 36B which are circumferentially spaced apart at approximately 120 degrees relative to each other. The three threaded openings are used with threaded fasteners to connect the integrated member 14 to the upper heating dissipating apparatus 15.

The upper heat dissipating apparatus 15 also has the shape of a hollow cylinder, which is another part of the heat dissipating means of the present invention. The upper heat dissipating apparatus 15 is comprised of a body 40 including an exterior cylindrical surface 41 and a transverse round top surface 43. The body is downwardly and concentrically connected to a bottom round plate 44 having a bottom surface 45 and an exterior circumference 46, so that the exterior surface 41 of the body connects to a top surface of the bottom round plate 44, wherein a diameter of the cylindrical body 40 is smaller than that of the bottom round plate 44. As further illustrated, a central longitudinal opening 42 penetrates through respective centers of the respective body and bottom round plate 40 and 44.

Formed into the exterior surface 41 of the cylindrical body 40 are a multiplicity of spaced apart arcuate longitudinal fins 47. The fins respectively extend outwardly away from the exterior surface 41 of the body to respective exterior end side 48, which circumferentially and downwardly connect to the exterior circumference 46 of the bottom plate 44. The exterior or end sides 48 of the respective arcuate fins 47 are aligned with the outer circumference 46 of the bottom round plate 44. Therefore, each identical longitudinal fin 47 is aligned at its top side with the top surface 43 of the body, and at its bottom side is connected to the bottom plate 44.

As further illustrated, each longitudinal fin 47 further extends in a transverse and counterclockwise arc away from the exterior surface 41 and from the top surface 43 with a continuous incremental angle to form each respective longitudinal end side 48, so that the fins 47 are arcuately oriented with respect to exterior surface 41 and top surface 43. In addition, each transversely arcuately longitudinal fin 47 is separated from an adjacent identical fin by an air gap 49. Therefore, the upper heat dissipating apparatus 15 having the multiplicity of arcuately extending and spaced apart heat dissipation fins 47 and multiplicity of air gaps 49 serves as another part of the heat dissipating means of the present invention, with each respective longitudinal heat dissipation fin 47 separated from an adjacent identical fin by an air gap 49, wherein the multiplicity of arcuately extending and spaced apart heat dissipation fins 47 and multiplicity of air gaps 49 are principal components for dissipating heat.

Referring to FIG. 1 and FIG. 4A there is illustrated three structural characters of the respective identical longitudinal arcuate fins 32 and 47. First, the longitudinal outer end sides 33 and 48 of the respective arcuate fins of the respective upper and lower heat dissipating apparatus 15 and 25 are aligned with each other and are aligned in series. Second, a curvature of each identical longitudinal arcuate fin 47 of the upper heat dissipating apparatus 15 is the same as the curvature of each longitudinal arcuate fin 32 of the lower heat dissipating apparatus 25, and the curvature of each respective air gap 49 and 34 are also the same. Third, the vertical length "L1" of each identical longitudinal arcuate fin 47 of the upper heat dissipating apparatus can be longer than the vertical length "L2" of each arcuate fin 32 of the lower apparatus. It is also within the spirit and scope of the present invention for the vertical lengths "L1" and "L2" to be the same. The arcuate radius "R1" of each identical longitudinal arcuate fin 47 of the upper heat dissipating apparatus is longer than the arcuate radius "R2" of each arcuate fin 32 because the diameter of the exterior circular surface 41 of the upper heating dissipating apparatus 15 is smaller than that of the exterior circular surface 29 of the lower heat dissipating apparatus.

While the fins 32 and 47 are illustrated with a curvature extending in a counter-clockwise direction, it will be appreciated that it is also within the spirit and scope of the present invention for the fins 32 and 47 to curve in the clockwise direction.

Therefore, another important improvement of the present invention is the arcuate curvature of the longitudinal arcuate fins 32 and 47 and respective corresponding air gaps 34 and 49 provide larger heat dissipation surface areas as compared with prior art fins which are straight and not curved and which therefore have smaller heat dissipation surface areas. Therefore the present invention multiple arcuate fins 32 and 47 having the larger surface areas provide more effective cooling and more efficient air circulation through the respective arcuate air gaps 34 and 49, as compared the prior art longitudinal straight fins having the smaller surface areas.

In addition, there are three downwardly extending openings 50, 50A and 50B penetrating body 40 of the heat dissipating apparatus 15 and are circumferentially spaced apart by 120 degrees. As illustrated, theses three longitudinal openings 50, 50A and 50B in heat dissipating apparatus 15 are positioned to be respectively vertically aligned with the three threaded openings 36, 36A and 36B on the lower heat dissipating apparatus 25 which opening extends into heat dissipating apparatus 25. Therefore, the upper and lower heat dissipating apparatus 15 and 25 can be connected together in series by three threaded fasteners 66, 66A and 66B which respectively extend through an opening 50, 50A and 50B and are threaded into female threaded openings 36, 36A and 36B.

As further illustrated in FIG. 4A, there is a LED chip 54 having two connecting openings 56A and 56B. In addition, a thermal conductive grease or patch 57 is positioned on the interior side of the LED chip 54. Therefore, the LED chip 54 is thermally conductively affixed to the bottom surface 45 of the upper heat dissipating apparatus 15 by affixing mean such as threaded screws or bolts that penetrate through the respective connecting openings 56A and 56B of the chip to connect to corresponding threaded openings positioned on the bottom surface 45, wherein the thermal conductive grease or patch 57 fills gaps caused by rough surfaces of the respective LED chip and bottom surface 45 of the body 40 so that heat generated by the LED during use is transferred to the connected upper and lower heat dissipating apparatus 15 and 25 for the heat dissipation. The chip 54 is additionally comprised of a downward dome shaped LED 55 which functions as the source of illumination. The downward dome shaped LED 55 is positioned at a center of an exterior surface of the chip 54. The LED is electrically connected to wires 58, which further penetrate through the wire connecting opening 52 of the upper heat dissipating apparatus 15 and then connected to an external source of electrical power, so that the LED serves as the lighting source when it is connected to the source of electricity.

Referring to FIG. 4A, there is illustrated a top cover plate 62 having a size that is similar to a size of the top round surface 43 of the upper heat dissipating apparatus 15, so that the plate will not block pathways of the air circulation from the respective air gaps 49. The plate additionally has a wire connecting opening 63 which is aligned with the wire connecting opening 52 and three fastener connecting openings 64, 64A and 64B which are respectively aligned with fastener openings 50, 50A and 50B on the upper heat dissipating apparatus 15. Therefore, fastener means such as threaded screws 66, 66A and 66B are able to penetrate through the respective fastener connecting openings 64, 64A and 64B on the top plate 62 and the respective fastener receiving openings 50, 50A and 50B of the upper heat dissipating apparatus 15 to connect to the respective threaded affixing openings 36, 36A and 36B of the lower heat dissipating apparatus 25 to thereby form a detachable heat dissipating means of the present invention.

When the upper heat dissipating apparatus 15 is connected to the lower heat dissipating apparatus 25, each respective fin 47 is aligned with reach respective fin 32, so that each respective exterior longitudinal side 48 of each respective fin 47 is aligned with each respective exterior longitudinal side 33 of each respective fin 32. In addition, each respective air gap 49 of the upper heat dissipating apparatus 15 is aligned with each respective air gap 34 of the lower heat dissipating apparatus 25.

Therefore, an additional significant improvement of the present invention is that the upper heat dissipating apparatus and lower heat dissipating apparatus affixed with the light reflector can be detached so that one of them can easily be, replaced if the one fails.

Figure 5:
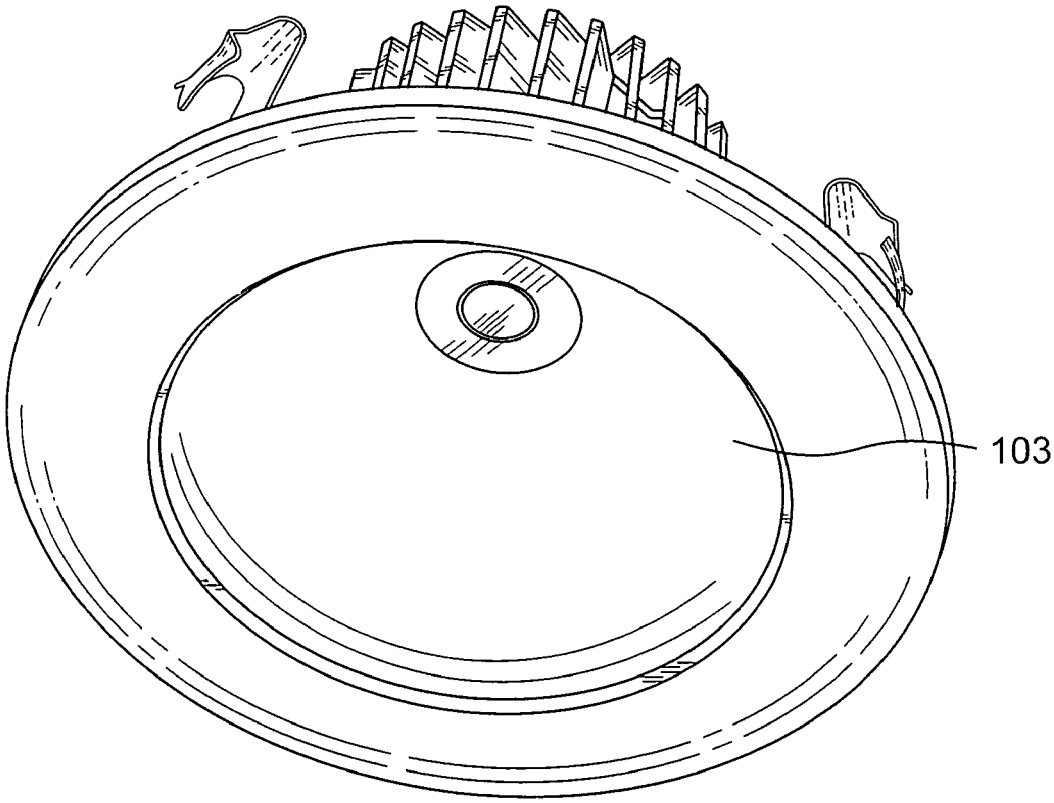
FIG. 5 is a bottom perspective view of the small sized LED lighting luminaire of the present invention illustrating an alternative embodiment of the reflector which has a smooth interior surface.

In this setting, the LED chip 54 attached on the bottom surface 45 of the upper heat dissipating apparatus 15 is positioned into the interior round recess 29 of the lower heat dissipating apparatus 25, and further to be aligned with its central opening 27, wherein the central opening 27 is surround by the top interior plate 21 of the light reflector 16. Therefore, light emitted from the LED 55 will first be regulated to pass through the opening 27 and then is enhanced by the transverse circular baffles 24 of the reflector to achieve an aesthetic lighting effect. Therefore an additional improvement of the present invention is to apply the transverse circular baffles onto the interior surface of the reflector, which enhance the aesthetic lighting effect, as compared with a smooth interior surface 102 of a light reflector 5 as illustrated in an alternative embodiment as shown in FIG. 5.

Further referring to FIG. 4A, the connecting wires 58, after penetrating through the wire receiving opening 63 of the top plate is connected to a mating connecting member 60. The member 60 is one of two matched mating connecting members of a detachable connector, wherein another mating connecting member is connected to a source of power supply, so that electricity can be supplied to the LED chip 54. With application of the detachable connector having two mating connecting members, the present invention has an easy electrical connection or disconnection of the two mating members to facilitate installation and maintenance of the lighting luminaire, which is additional improvement of the present invention as compared with the prior art.

Figure 4B:
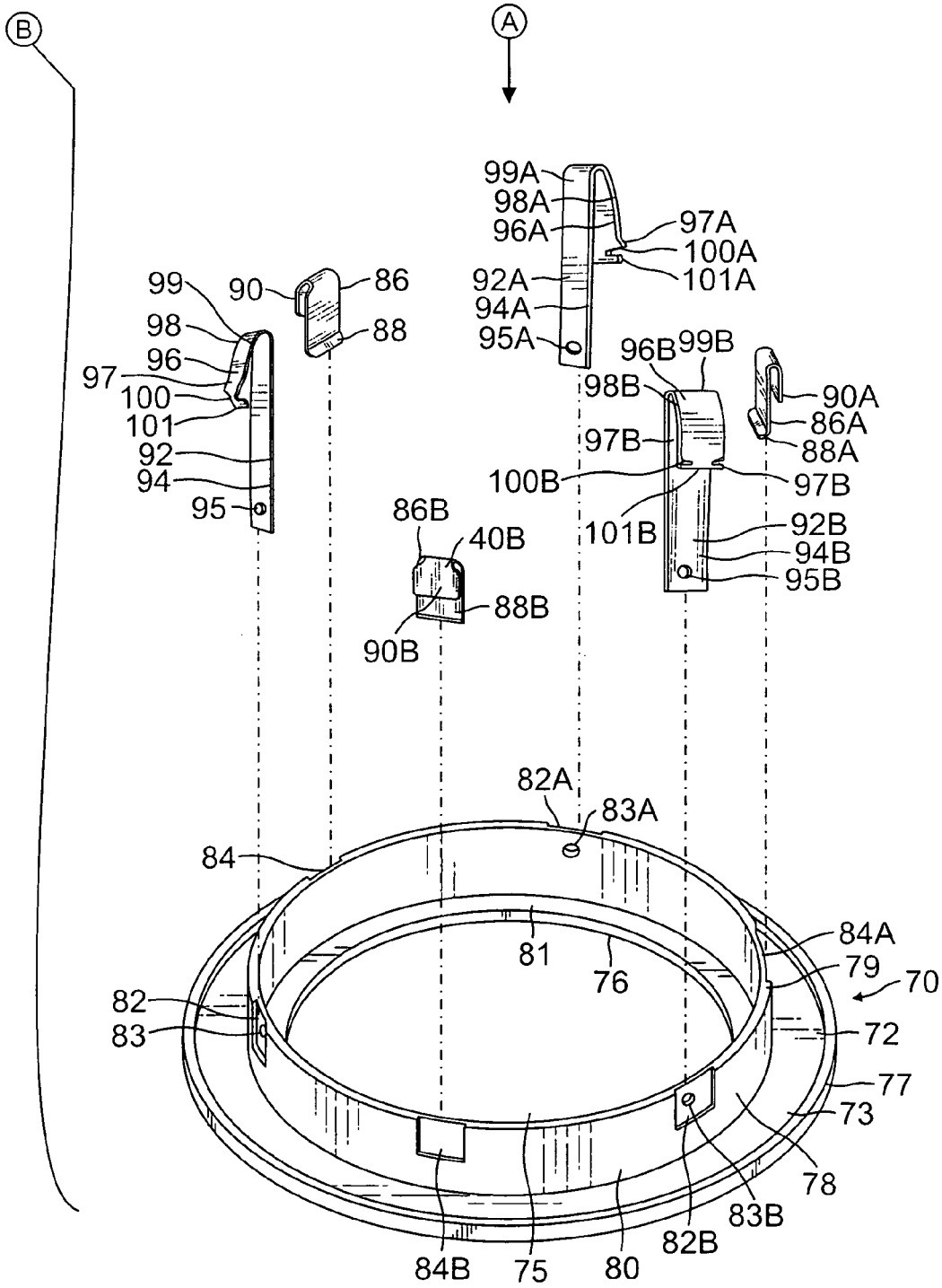
FIG. 4B is an exploded perspective view of a portion of the present invention small sized lighting luminaire illustrating a bottom ring cover and attaching members by which the luminaire is retained in a ceiling cannister.

Referring to FIG. 4B, there is illustrated bottom cylindrical ring cover 70 which is incorporated with a plurality of clips or affixing means 86, 86A and 86B which are used to affix the detachable heat dissipating means incorporated with the light reflector 14 to the bottom cylindrical ring cover 70. The ring cover also has multiple attachment hooks or attachment means 92, 92A and 92B for attaching the present invention small sized recessed LED lighting luminaire to a room structure or a ceiling canister 110.

The bottom cylindrical ring cover 70 is comprised of a bottom ring 72 having interior and exterior surfaces 73 and 22, a central opening 75 surrounded by an interior circumference 76, and an exterior circumference having a circular upwardly extend rim 77. In addition, a circular wall 78 having a circular top 79 and an exterior surface 80 is connected to the interior surface 73 of the ring 72 adjacent the interior circumference 76 to thereby from an interior circular shelf 81.

As further illustrated in FIG. 4B, there are a plurality of rectangular indentations 82, 82A and 82B are circumferentially spaced apart on exterior surface 80 and are aligned with circular top side 79 of the upward circular wall 78, wherein each identical indentation 82, 82A and 82B has a respective central threaded opening 83, 83A and 83B penetrating therethrough. In addition, a plurality of additional rectangular indentations 84, 84A and 84B are circumferentially spaced apart on exterior surface 80 and are also aligned with circular top side 79 of the upward circular wall. These additional indentations 84, 84A and 84B do not have central threaded openings. Each respective indentation 84, 84A and 84B are respectively positioned between two indentations 82, 82A and 82B. Each identical indentation 84 without the central opening is further illustrated to position between two, and further to have equal distance to the respective adjacent identical two indentations 82. It will be appreciated that the indentations 82, 82A and 82B respectively receive attachment means 92, 92A and 92B and indentations 84, 84A and 84B respectively receive affixing means 86, 86A and 86B.

Each of the preferable three identical affixing means 86 has the shape of an inverted "J", including a bottom end connected to an inward rim 88, 88A and 88B and an outwardly bent top head 90, 90A and 90B.

Each of the three identical attachment means 92, 92A and 92B also has the shape of the inverted "J", including a vertical wall 94, 94A and 94B with an opening 95, 95A and 95B extending through it and a downwardly bent top section 96, 96A and 96B. As further illustrated in FIG. 4B, a pair of outward attachment hooks 97, 97A and 97B are positioned on the respective two longitudinal edges 98, 98A 98B and 99, 99A and 99B of the respective top sections, which are further incorporated with the respective two gaps 100, 100A and 100B positioned adjacent a bottom end 101, 101A and 101B of the respective top sections.

When assembling the present invention small sized LED lighting luminaire 10, the detachable heat dissipating means incorporated with the light reflector including the connected upper and lower heat dissipating apparatus 15 and 25 is positioned inside of the bottom ring cover 70. In this setting, the outer lower surface 22 of the reflector 16 is in contact with the inner circular shelf 81. The reflector is then firmly affixed by application of the three affixing means such as clips 86, 86A and 86B wherein each respective inward rim 88, 88A and 88B of each respective clip is positioned to firmly and downwardly press on top of the upward rim 23 of the reflector 16 after each respective downward head 90, 90A and 90B of a respective clip 86, 86A and 86B is press-fit into each respective indentation 84, 84A and 84B.

Each respective identical attachment means 92, 92A and 92B is affixed to the bottom ring cover 70, wherein each respective wall 94, 94A and 94B is positioned into each respective indentation 82, 82A and 82B. In addition, an affixation means such as a screw 102, 102A and 102B penetrates through each respective opening 95. 95A and 95B of the attachment means 92, 92A and 92B to thread into each respective central threaded opening 83, 83A and 83B. Therefore, the present invention is ready for installation into a canister 110 shown in dotted lines of FIG. 1. In that setting, each respective outward hook 97, 97A and 97B is in contact with an interior surface of the canister by outward forces of the bent top section 96 of the attachment means. This generates the corresponding friction forces of each respective hook 97, 97A and 97B applied to the canister sidewall, which keep the present invention lighting luminaire positioned inside of the canister. Therefore, the installed lighting luminaire is easily removed when applying a downward force to the luminaire 10 to overcome the friction forces generated by the attachment means 92, 92A and 92B.

It will be appreciated that, it is within the spirit and scope of the present invention to have only at least two attachment means 92, and 92A for installation of the small sized LED lighting luminaire 10 onto the canister.

The present invention lighting luminaire 10 has many unique structural features that provide user-friendly properties and are more convenient for luminaire maintenance. As discussed, the lighting luminaire 10 has the longitudinal arcuate fins 32 and 47, which have the respective larger surface areas, as compared with the longitudinal linear fins of the existing lighting luminaires in the market that have the respective smaller surface areas. Therefore, the present invention provides more efficient cooling and heat dissipation to remove heat generated by the LED.

Referring the above illustration of the structural components and procedures to assemble the lighting fixture, it is evident that the present invention lighting luminaire possesses the features of the detachable components which are replaceable, such as the detachable upper heat dissipating apparatus affixed with the LED chip, and detachable lower heating dissipating apparatus affixed with the light reflector, and detachable bottom ring cover. Such characteristics provides more convenience in service especially in repairing the luminaire. The result is a significant benefit including a low cost over the prior art lighting luminaires in the market which have non-detachable and therefore non-replaceable components.

It will be appreciated that the present invention provides the transverse circumferential baffles on the interior surface of the reflector, which are able to produce aesthetic lighting effect. This compares with the smooth interior surface 103 of an alternative embodiment of the present invention reflector illustrated in FIG. 5, which provides an intense lighting effect.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A luminaire comprising:

a. detachable and replaceable components including a heat dissipation assembly comprised of a lower and upper detachable heat dissipating means with transverse arcuate longitudinal heat dissipation fins for effectively dissipating heat generated from an LED source of illumination;

b. the detachable lower heat dissipating apparatus having a hollow light reflector attached thereto, the lower heat dissipating apparatus having a shape of a hollow cylinder including a body which has a central opening, a top transverse ring surface connected to an exterior cylindrical surface, a transverse round recessed plate concentrically positioned relative to the transverse ring surface on its exterior circumference and also surrounding an interior recessed plate which has an interior circumference 1 which surrounds the central opening, formed into the exterior surface of the cylindrical body are a multiplicity of spaced apart transversely extending arcuate longitudinal fins which extend outwardly away from the exterior surface, and also extend downwardly and are affixed to the exterior surface of the reflector, so that the lower heat dissipating apparatus and reflector are formed as an integrated member, each longitudinal fin further extends in a transverse arc away from the exterior surface and from the ring surface with a continuous incremental angle to form each respective longitudinal end side, so that the fins are arcuately oriented with respect to exterior surface and top transverse ring surface, each transversely extending arcuately longitudinal fin is separated from an adjacent identical fin by an air gap;

c. the upper heat dissipating apparatus also has the shape of a hollow cylinder, including a body having an exterior cylindrical surface and a transverse round top surface, the body is downwardly and concentrically connected to a bottom round plate having a bottom surface and an exterior circumference so that the exterior surface of the body connects to a top surface of the bottom round plate wherein a diameter of the cylindrical body is smaller than that of the bottom round plate, a central longitudinal opening through respective centers of the respective body and bottom round plate, formed into the exterior surface of the cylindrical body are a multiplicity of spaced apart arcuate longitudinal fins which respectively extend outwardly away from the exterior surface of the body to respective exterior end sides which circumferentially and downwardly connect to the exterior circumference of the bottom plate, the exterior or end sides of the respective arcuate fins are aligned with the outer circumference of the bottom round plate so that each identical longitudinal fin is aligned at its top side with the top surface of the body, and at its bottom side is connected to the bottom plate, each longitudinal fin further extends in a transverse arc away from the exterior surface and from the top surface with a continuous incremental angle to form each respective longitudinal end side so that the fins are arcuately oriented with respect to exterior surface and top surface each transversely arcuately longitudinal fin is separated from an adjacent identical fin by an air gap;

d. an LED chip having connecting openings, a thermal conductive grease is positioned on an interior side of the LED chip, the LED chip affixed to the bottom surface of the upper heat dissipating apparatus by affixing means wherein the thermal conductive grease fills gaps caused by rough surfaces of the respective LED chip and bottom surface of the body so that heat generated by the LED during use is transferred to the connected upper and lower heat dissipating apparatus for the heat dissipation, the chip is additionally comprised of a downward dome shaped LED which functions as the source of illumination, the downward dome shaped LED is positioned at a center of an exterior surface of the chip, the LED is electrically connected to wires which further penetrate through a wire connecting opening of the upper heat dissipating apparatus and then is connected to an external source of electrical power, so that the LED serves as the lighting source when it is connected to the source of electricity;

e. a top cover plate including a plurality of fastener connecting openings and a wire connecting opening; and f. fastening means which connect the top round plate, the upper heat dissipating apparatus and the lower heat dissipating apparatus together so that illumination from the LED chip shines through the reflector, the longitudinal fins and air gaps of the upper and lower heat dissipation apparatus aligned to provide effective heat dissipation of heat generated from the LED chip.

2. The luminaire in accordance with claim 1, wherein the top cover plate has a size that is similar to a size of the top round surface of the upper heat dissipating apparatus, so that the plate will not block pathways of the air circulation from the respective air gaps, the top cover plate additionally has a wire connecting opening which is aligned with the wire connecting opening of the upper heat dissipation apparatus and fastener connecting openings which are respectively aligned with fastener openings on the upper heat dissipating apparatus so that fastener means penetrate through the respective fastener connecting openings on the top cover plate and the respective fastener receiving openings of the upper heat dissipating apparatus to connect to respective fastener receiving openings in the lower heat dissipating apparatus.

3. The luminaire in accordance with claim 1, wherein the upper heat dissipating apparatus is connected to the lower heat dissipating apparatus so that each respective fin of the upper heat dissipating apparatus is aligned with a respective fin of the lower heat dissipating apparatus so that respective air gaps of the upper and lower heat dissipation apparatus are also aligned.

4. The luminaire in accordance with claim 1, wherein the LED chip attached on the bottom surface of the upper heat dissipating apparatus is positioned into the interior round recess of the lower heat dissipating apparatus and further aligned with its central opening wherein the central opening is surround by a top interior plate of the light reflector so that light emitted from the LED will first be regulated to pass through the opening and then is enhanced by transverse circular baffles on an interior surface of the reflector to achieve an aesthetic lighting effect.

5. The luminaire in accordance with claim 1, wherein the LED chip attached on the bottom surface of the upper heat dissipating apparatus is positioned into the interior round recess of the lower heat dissipating apparatus and further aligned with its central opening wherein the central opening is surround by a top interior plate of the light reflector so that light emitted from the LED will first be regulated to pass through the opening and then is focused by a smooth interior surface of the reflector.

6. The luminaire in accordance with claim 1, wherein the connecting wire after penetrating through the wire receiving opening of the top plate is connected to a mating connecting member which is one of two matched mating connecting members of a detachable connector, wherein another mating connecting member is connected to a source of power supply, so that electricity is supplied to the LED chip so that application of the detachable connector having two mating connecting members facilitates an easy electrical connection or disconnection of the two mating members to facilitate installation and maintenance of the luminaire.

7. The luminaire in accordance with claim 1, further comprising a bottom cylindrical ring cover which is incorporated with a plurality of affixing means which are used to affix the detachable lower heat dissipating means incorporated with the light reflector to the bottom cylindrical ring cover.

8. The luminaire in accordance with claim 7, further comprising the ring cover also has multiple attachment means for removably attaching the luminaire to a ceiling canister.

9. The luminaire in accordance with claim 8, wherein each of the attachment means has a shape of the inverted "J", including a vertical wall and a downwardly bent top section having a pair of outward attachment hooks positioned on respective two longitudinal edges of the respective top sections, the vertical walls attached to the ring section and each respective outward hook in contact with an interior surface of a ceiling canister to generate outward forces of the bent top section of the attachment means to generate friction forces of each respective hook applied to the canister sidewall, so that the luminaire is removably retained within the cannister.

10. The luminaire in accordance with claim 7, wherein the bottom cylindrical ring cover is comprised of a bottom ring having interior and exterior surfaces, a central opening surrounded by an interior circumference, and an exterior circumference having a circular upwardly extend rim, a circular wall having a circular top and an exterior surface which is connected to the interior surface of the ring adjacent the interior circumference to thereby from an interior circular shelf.

11. The luminaire in accordance with claim 1, wherein the arcuate longitudinal heat dissipating fins of the upper and lower heat dissipating members extend in a counter-clockwise direction.

12. The luminaire in accordance with claim 1, wherein the arcuate longitudinal heat dissipating fins of the upper and lower heat dissipating members extend in a clockwise direction.

13. The luminaire in accordance with claim 1, wherein the LED chip is a single chip which generates white light.

14. A luminaire comprising:

a. detachable and replaceable components including a heat dissipation assembly comprised of a lower and upper detachable heat dissipating means with transverse arcuate longitudinal heat dissipation fins for effectively dissipating heat generated from an LED source of illumination;

b. the detachable lower heat dissipating apparatus having a hollow light reflector attached thereto, the lower heat dissipating apparatus having a hollow body with an exterior surface and a transverse recessed plate, formed into the exterior surface of the body are a multiplicity of spaced apart transversely extending arcuate longitudinal fins which extend outwardly away from the exterior surface, and also extend downwardly and are affixed to an exterior surface of the reflector so that the lower heat dissipating apparatus and reflector are formed as an integrated member, each longitudinal fin further extends in a transverse arc away from the exterior surface so that the fins are arcuately oriented with respect to exterior surface, each transversely extending arcuately longitudinal fin is separated from an adjacent fin by an air gap;

c. the upper heat dissipating apparatus also has a hollow body having an exterior surface the body is downwardly and concentrically connected to a bottom plate having a bottom surface and an exterior circumference so that the exterior surface of the body connects to a top surface of the bottom plate, a central longitudinal opening through respective centers of the respective body and bottom plate, formed into the exterior surface of the body are a multiplicity of spaced apart arcuate longitudinal fins which respectively extend outwardly away from the exterior surface of the body and connect to the bottom plate, each longitudinal fin further extends in a transverse arc away from the exterior surface so that the fins are arcuately oriented with respect to exterior surface, each transversely arcuately longitudinal fins separated from an adjacent fin by an air gap;

d. an LED chip affixed to a bottom surface of the upper heat dissipating apparatus by affixing means wherein the thermal conductive grease is between the LED chip and the bottom surface to which the LED chip is attached so that heat generated by the LED chip during use is transferred to the connected upper and lower heat dissipating apparatus for the heat dissipation, the LED is electrically connected to wires which are then connected to an external source of electrical power, so that the LED chip serves as the lighting source when it is connected to the source of electricity; and e. fastening means which connect at least the upper heat dissipating apparatus and the lower heat dissipating apparatus together so that illumination from the Led chip shines through the reflector, the longitudinal fins and air gaps of the upper and lower heat dissipation apparatus aligned to provide effective heat dissipation of heat generated from the LED chip.

15. The luminaire in accordance with claim 14, further comprising a top cover plate sized so that the plate will not block pathways of the air circulation from the respective air gaps.

16. The luminaire in accordance with claim 14, wherein the upper heat dissipating apparatus is connected to the lower heat dissipating apparatus so that each respective fin of the upper heat dissipating apparatus is aligned with a respective fin of the lower heat dissipating apparatus so that respective air gaps of the upper and lower heat dissipation apparatus are also aligned.

17. The luminaire in accordance with claim 14, wherein the LED chip attached to the upper heat dissipating apparatus is positioned into an interior round recess of the lower heat dissipating apparatus and further aligned with its central opening wherein the central opening is surround by a top interior plate of the light reflector so that light emitted from the LED chip will first be regulated to pass through the opening and then is enhanced by transverse circular baffles on an interior surface of the reflector to achieve an aesthetic lighting effect.

18. The luminaire in accordance with claim 14, wherein the LED chip attached to the upper heat dissipating apparatus is positioned into the interior round recess of the lower heat dissipating apparatus and further aligned with its central opening wherein the central opening is surround by a top interior plate of the light reflector so that light emitted from the LED chip will first be regulated to pass through the opening and then is focused by a smooth interior surface of the reflector.

19. The luminaire in accordance with claim 14, wherein the connecting wires are connected to a mating connecting member which is one of two matched mating connecting members of a detachable connector, wherein another mating connecting member is connected to a source of power supply, so that electricity is supplied to the LED chip so that application of the detachable connector having two mating connecting members facilitates an easy electrical connection or disconnection of the two mating members to facilitate installation and maintenance of the luminaire.

20. The luminaire in accordance with claim 14, further comprising a bottom cylindrical ring cover which is incorporated with a plurality of affixing means which are used to affix the detachable lower heat dissipating means incorporated with the light reflector to the bottom cylindrical ring cover.

21. The luminaire in accordance with claim 20, further comprising the ring cover also having multiple attachment means for removably attaching the luminaire to a ceiling canister.

22. The luminaire in accordance with claim 21, wherein each of the attachment means has a shape of the inverted "J", including a vertical wall and a downwardly bent top section having a pair of outward attachment hooks positioned on respective two longitudinal edges of the respective top sections, the vertical walls attached to the ring section and each respective outward hook in contact with an interior surface of a ceiling canister to generate outward forces of the bent top section of the attachment means to generate friction forces of each respective hook applied to the canister sidewall, so that the luminaire is removably retained within the cannister.

23. The luminaire in accordance with claim 20, wherein the bottom cylindrical ring cover is comprised of a bottom ring having interior and exterior surfaces, a central opening surrounded by an interior circumference, and an exterior circumference having a circular upwardly extend rim, a circular wall having a circular top and an exterior surface which is connected to the interior surface of the ring adjacent the interior circumference to thereby from an interior circular shelf.

24. The luminaire in accordance with claim 14, wherein the arcuate longitudinal heat dissipating fins of the upper and lower heat dissipating members extend in a counter-clockwise direction.

25. The luminaire in accordance with claim 14, wherein the arcuate longitudinal heat dissipating fins of the upper and lower heat dissipating members extend in a clockwise direction.

26. The luminaire in accordance with claim 14, wherein the LED chip is a single chip which generates white light.

27. A luminaire comprising:

a. detachable and replaceable components including a heat dissipation assembly comprised of a lower and upper detachable heat dissipating means with transverse arcuate longitudinal heat dissipation fins for effectively dissipating heat generated from an LED source of illumination;

b. the detachable lower heat dissipating apparatus having a hollow body with an exterior surface with a multiplicity of spaced apart transversely extending arcuate longitudinal fins which extend outwardly away from the exterior surface, each longitudinal fin further extends in a transverse arc away from the exterior surface so that the fins are arcuately oriented with respect to exterior surface, each transversely extending arcuately longitudinal fin is separated from an adjacent fin by an air gap;

c. the upper heat dissipating apparatus also has a hollow body having an exterior surface with a multiplicity of spaced apart arcuate longitudinal fins which respectively extend outwardly away from the exterior surface of the body, each longitudinal fin further extends in a transverse arc away from the exterior surface so that the fins are arcuately oriented with respect to exterior surface, each transversely arcuately longitudinal fins separated from an adjacent fin by an air gap;

d. an LED chip affixed to the upper heat dissipating apparatus so that heat generated by the LED chip during use is transferred to the connected upper and lower heat dissipating apparatus for the heat dissipation, the LED is electrically connected an external source of electrical power, so that the LED chip serves as the illumination source when it is connected to the source of electrical power;

e. a reflector; and f. fastening means which connect at least the upper heat dissipating apparatus and the lower heat dissipating apparatus together so that illumination from the Led chip shines through the reflector, the longitudinal fins and air gaps of the upper and lower heat dissipation apparatus aligned to provide effective heat dissipation of heat generated from the LED chip.

28. The luminaire in accordance with claim 27, further comprising a top cover plate sized so that the plate will not block pathways of the air circulation from the respective air gaps.

29. The luminaire in accordance with claim 27, wherein the upper heat dissipating apparatus is connected to the lower heat dissipating apparatus so that each respective fin of the upper heat dissipating apparatus is aligned with a respective fin of the lower heat dissipating apparatus so that respective air gaps of the upper and lower heat dissipation apparatus are also aligned.

30. The luminaire in accordance with claim 27, wherein the LED chip attached to the upper heat dissipating apparatus is positioned so that light emitted from the LED chip will first be regulated to pass through transverse circular baffles on an interior surface of the reflector to achieve an aesthetic lighting effect.

31. The luminaire in accordance with claim 27, wherein the LED chip attached to the upper heat dissipating apparatus is positioned so that light emitted from the LED chip will first be regulated to pass through a smooth interior surface of the reflector.

32. The luminaire in accordance with claim 27, wherein the connection to the source of electrical power includes mating connectors so that electricity is supplied to the LED chip so that application of the detachable connector having two mating connecting members facilitates an easy electrical connection or disconnection of the two mating members to facilitate installation and maintenance of the luminaire.

33. The luminaire in accordance with claim 27, further comprising a bottom cylindrical ring cover which is incorporated with a plurality of affixing means which are used to affix the detachable lower heat dissipating means incorporated with the light reflector to the bottom cylindrical ring cover.

34. The luminaire in accordance with claim 33, further comprising the ring cover also having multiple attachment means for removably attaching the luminaire to a ceiling canister.

35. The luminaire in accordance with claim 34, wherein each of the attachment means has a shape of the inverted "J", including a vertical wall and a downwardly bent top section having a pair of outward attachment hooks positioned on respective two longitudinal edges of the respective top sections, the vertical walls attached to the ring section and each respective outward hook in contact with an interior surface of a ceiling canister to generate outward forces of the bent top section of the attachment means to generate friction forces of each respective hook applied to the canister sidewall, so that the luminaire is removably retained within the cannister.

36. The luminaire in accordance with claim 33, wherein the bottom cylindrical ring cover is comprised of a bottom ring having interior and exterior surfaces, a central opening surrounded by an interior circumference, and an exterior circumference having a circular upwardly extend rim, a circular wall having a circular top and an exterior surface which is connected to the interior surface of the ring adjacent the interior circumference to thereby from an interior circular shelf.

37. The luminaire in accordance with claim 27, wherein the arcuate longitudinal heat dissipating fins of the upper and lower heat dissipating members extend in a counter-clockwise direction.

38. The luminaire in accordance with claim 27, wherein the arcuate longitudinal heat dissipating fins of the upper and lower heat dissipating members extend in a clockwise direction.

39. The luminaire in accordance with claim 27, wherein the LED chip is a single chip which generates white light.

* * * * *